US005165663A

United States Patent [19]

Wells

[11] Patent Number: 5,165,663

[45] Date of Patent: Nov. 24, 1992

[54] GROUND ANCHOR FOR FENCE POST, AND DRIVING MEMBER FOR INSTALLING IT

[76] Inventor: Rolfe L. Wells, 62590 M-62, South, Cassopolis, Mich. 49031

[21] Appl. No.: 801,446

[22] Filed: Dec. 2, 1991

[51] Int. Cl.[5] ..... E04H 17/14

[52] U.S. Cl. ..... 256/19; 256/1; 52/165

[58] Field of Search ..... 256/1, 19; 52/165, 298, 52/103

[56] References Cited

U.S. PATENT DOCUMENTS

| | | | |
|---|---|---|---|
| 3,378,967 | 4/1968 | Baumeister | 52/165 X |
| 3,630,489 | 12/1971 | Cordell, Sr. | 52/298 X |
| 4,787,601 | 11/1988 | Rybak | 256/19 |
| 4,815,713 | 3/1989 | Schmanski | 256/1 X |

FOREIGN PATENT DOCUMENTS

| | | | |
|---|---|---|---|
| 2-42919 | 9/1989 | Japan | 52/103 |

*Primary Examiner*—Andrew V. Kundrat

*Attorney, Agent, or Firm*—Flynn, Thiel, Boutell & Tanis

[57] ABSTRACT

A ground anchor for a post includes an elongate, vertically extending cylindrical PVC tube and includes at the lower end of the tube an end member having a cylindrical portion snugly frictionally fit within the tube and a conical portion projecting downwardly from the tube to a point, the end member having thereon within the tube an upwardly facing drive surface. An elongate driving member is removably insertable into the tube and has at one end a driving surface which is engageable with the drive surface on the end member. In a variation, the tube has at the upper end thereof a collar which includes an axially extending annular flange snugly fit within the upper end of the tube and a further annular flange projecting radially outwardly from the upper end of the axial flange.

16 Claims, 3 Drawing Sheets

GROUND ANCHOR FOR FENCE POST, AND DRIVING MEMBER FOR INSTALLING IT

FIELD OF THE INVENTION

The present invention relates generally to a ground anchor for a post and a driving member for driving the ground anchor into the ground and, more particularly, to such a ground anchor and driving member in which damage to the ground member is reliably avoided while it is being driven into the ground by the driving member.

BACKGROUND OF THE INVENTION

Golf courses frequently need to ensure that motorized golf carts do not drive on certain areas of the course. Therefore, an inexpensive fence is often created by inserting the lower ends of several posts into spaced holes in the ground, and then stringing a single piece of synthetic rope or cord across the upper ends of the posts. A very inexpensive material suitable for use as posts is polyvinyl chloride (PVC) pipe. For mowing, the posts are removed from the ground, a lawn mower is driven over the holes for the posts, and then the posts are reinserted into their holes. Over time, the holes in the ground become enlarged, and as a result the posts will wobble.

It has therefore become common to also provide a ground anchor for the post which is disposed in the ground and resists enlargement of the hole in order to reliably maintain the post in a proper upright position with little or no wobble. Usually, the ground anchor is a short section of PVC pipe which has an inside diameter slightly larger than the outside diameter of the post, which is driven into a hole in the ground, and which removably receives the lower end of the post. Most commonly, driving forces are applied to the upper end of the short section of pipe, which usually deforms the upper end and in some cases produces cracks in the pipe. Further, the lower end of this pipe section may be deformed or cracked by resistance of the ground as the pipe section is driven into the ground, particularly during dry weather.

Accordingly, one object of the present invention is to provide an improved ground anchor and a driving member which permits the ground member to be driven into the ground quickly and with no damage thereto.

SUMMARY OF THE INVENTION

The objects and purposes of the invention, including those set forth above, are met according to a first form of the invention by providing a ground anchor for a post, the ground anchor including an elongate vertically extending tube and an end member fixedly supported on a lower end of the tube and having a downwardly projecting pointed portion, the end member having thereon within the tube an upwardly facing drive surface.

A different form of the present invention involves the provision, in association with the ground anchor just described, of an elongate, vertically extending driving member having a lower end portion vertically slidably insertable into the tube and having on the lower end portion a downwardly facing driving surface engageable with the drive surface on the end member.

BRIEF DESCRIPTION OF THE DRAWINGS

Two preferred embodiments of the invention will be described in detail hereinafter with reference to the accompanying drawings, in which.

DETAILED DESCRIPTION

Figure 1:
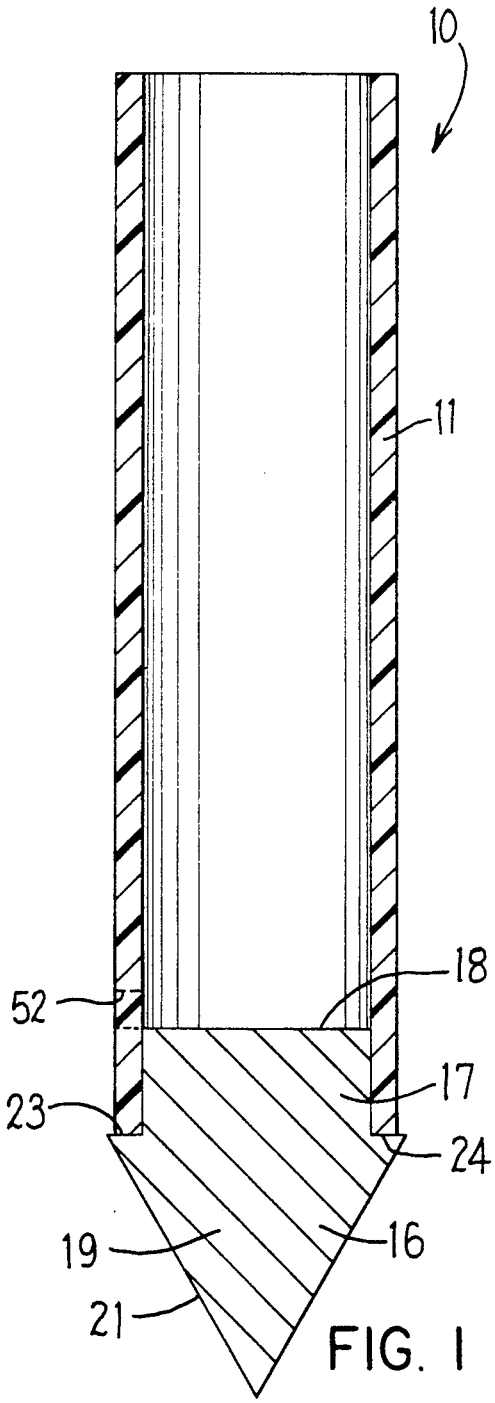
FIG. 1 is a central sectional side view of a ground anchor embodying the present invention.
Figure 3:
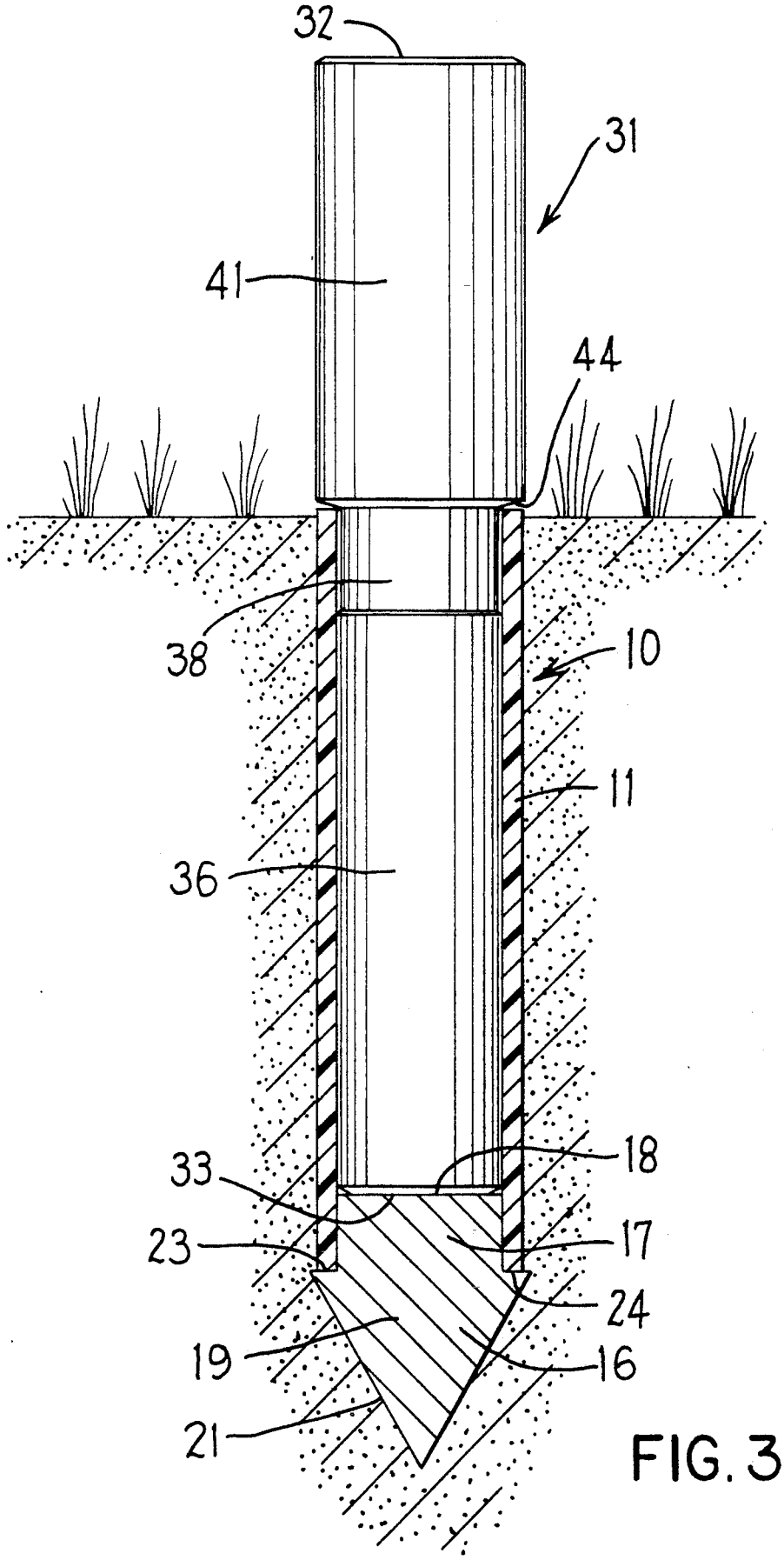
FIG. 3 is a sectional side view showing how the ground anchor of FIG. 1 is driven into the ground by the driving member of FIG. 2.

Referring to FIG. 3, a preferred embodiment of the present invention includes a ground anchor 10 which can support a post and which is also shown in FIG. 1. Referring to FIG. 1, the ground anchor 10 includes a cylindrical vertical tube 11 which, in the preferred embodiment, is made of polyvinyl chloride (PVC).

The ground anchor 10 also includes at the lower end of the tube 11 a metal end member 16. The end member 16 has a cylindrical upper portion 17 with an outside diameter substantially equal to the inside diameter of the tube 11, the cylindrical portion 17 being snugly frictionally received within the lower end of the tube 11 in order to fixedly support the end member 16 on the tube 11. The tube 11 can optionally be adhesively secured to the end member 16 with a suitable conventional adhesive, although in the preferred embodiment the frictional fit is sufficient without an adhesive. The cylindrical portion 17 has at the upper end thereof a circular drive surface 18 which faces upwardly within the tube 11. A lower portion 19 of the end member 16 is a cone, the cylindrical portion 17 projecting concentrically upwardly from the base of the cone. The cone 19 has thereon a conical exterior surface 21 which converges downwardly to a point. The diameter of the cone 19 at the base of the cone (the upper end) is approximately equal to or is slightly greater than the outside diameter of the tube 11, thereby creating on the end member 16 an upwardly facing annular step 23 which is disposed against a lower end 24 of the tube 11.

Figure 2:
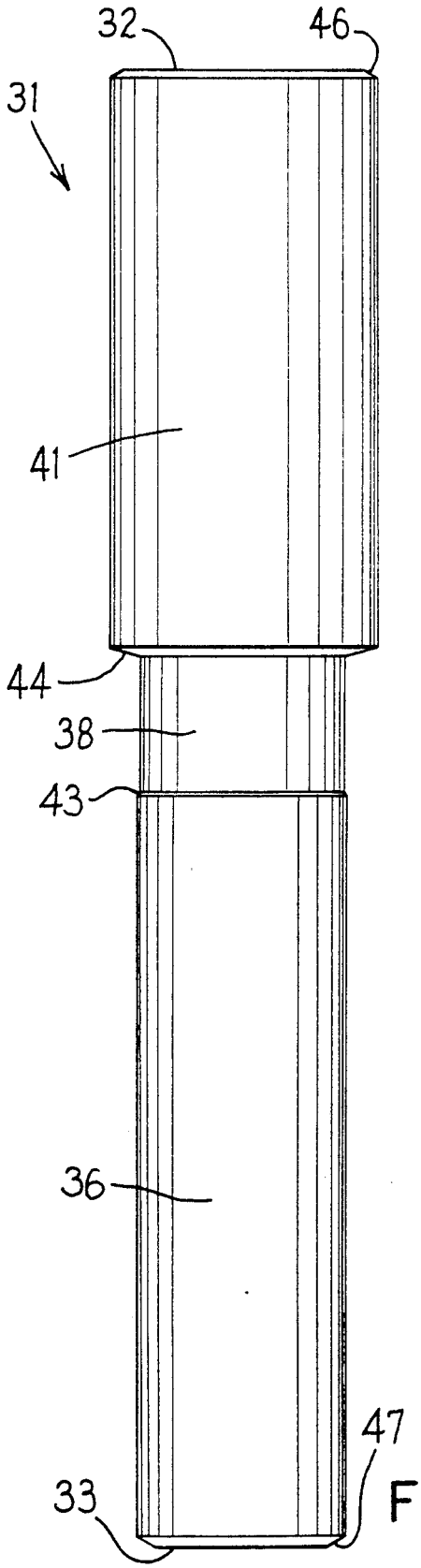
FIG. 2 is an elevational side view of a driving member according to the invention which is suitable for use with the ground anchor of FIG. 1.

The apparatus shown in FIG. 3 also includes a cylindrical driving member 31, which is a solid piece of metal and is shown in more detail in FIG. 2. The driving member 31 has at an upper end thereof an upwardly facing drive surface 32, and has at a lower end thereof a downwardly facing driving surface 33. A lower portion 36 of the driving member 31 has a diameter which is less than the inside diameter of the tube 11, and the upper portion 41 of the driving member 31 has a diameter which is approximately equal to the outside diameter of the tube 11. Between the upper and lower portions 36 and 41 is a short central portion 38 having a diameter less than the diameter of the lower portion 36, so that an upwardly facing annular step 43 is defined between the lower portion 36 and the central portion 38, and a downwardly facing annular step 44 is defined between the upper portion 41 and central portion 38. An annular bevel 46 can optionally be provided at the upper end of the driving member 31, and a similar annular bevel 47 can be provided at the lower end thereof.

As shown in broken lines in FIG. 1, an optional drain hole 52 can be provided to allow rainwater which collects in the tube 11 to drain into the surrounding ground.

In use, the lower portion 36 of the driving member 31 is removably and slidably inserted into the tube 11 of the ground anchor 10, until the downwardly facing driving surface 33 at the lower end of the driving member 31 is disposed against the upwardly facing drive surface 18 on the end member 16 of the ground anchor, as shown in FIG. 3. It will be noted from FIG. 3 that, when the driving surface 33 is engaging drive surface 18, the annular step 44 is spaced upwardly a small distance from and does not engage the upper end of the tube 11.

Then, the point at the lower end of the end member 16 is placed against the ground, and a not-illustrated conventional hammer is used to apply blows to the upwardly facing drive surface 32 on driving member 31, the forces applied by the hammer being transferred directly through the driving member 31 to the end member 16 so that the end member 16 is driven downwardly into the ground, the tube 11 being drawn into the ground behind the end member 16. Since the base of the conical portion 19 of the end member 16 has a diameter approximately equal to or slightly larger than the outside diameter of the tube 11, the tube 11 can easily follow the end member 16 into the ground. Since the annular step 44 is spaced a small distance above the upper end of the tube 11, and thus applies no driving forces to the upper end of the tube 11, the upper end of the tube 11 is not subjected to any forces which would deform or crack it in any way as the ground anchor 10 is driven into the ground.

Rather than using a hammer, the upper portion 41 of the driving member 31 can be manually grasped and the driving member 31 can be vertically manually reciprocated within the tube 11, so that the driving member 31 itself delivers blows to the end member 16 which drive end member 16 into the ground. Again, the end member 16 draws the tube 11 into the ground behind it.

When the ground anchor 10 has been driven into the ground to the position shown in FIG. 3, in which the upper end thereof is approximately level with the surface of the ground, the driving member 31 is slid vertically upwardly out of the ground anchor 10, leaving the ground anchor 10 in the ground. Thereafter, a not-illustrated cylindrical post which is longer than the tube 11 and which has an outside diameter slightly less than the inside diameter of the tube 11 can have its lower end removably inserted into the tube 11. Subsequently, the post can be removed from and reinserted into the tube 11 at any time, for example so that a lawn mower can pass over the ground anchor without contacting the ground anchor.

A single driving member 31 can, of course, be used to install many successive ground anchors 10.

It will be recognized that the driving member 31 could be longer than is show in FIGS. 2 and 3, so that it is not necessary for a person to kneel down or bend over in order to hit the upper end of the driving member 31 with a hammer.

Figure 4:
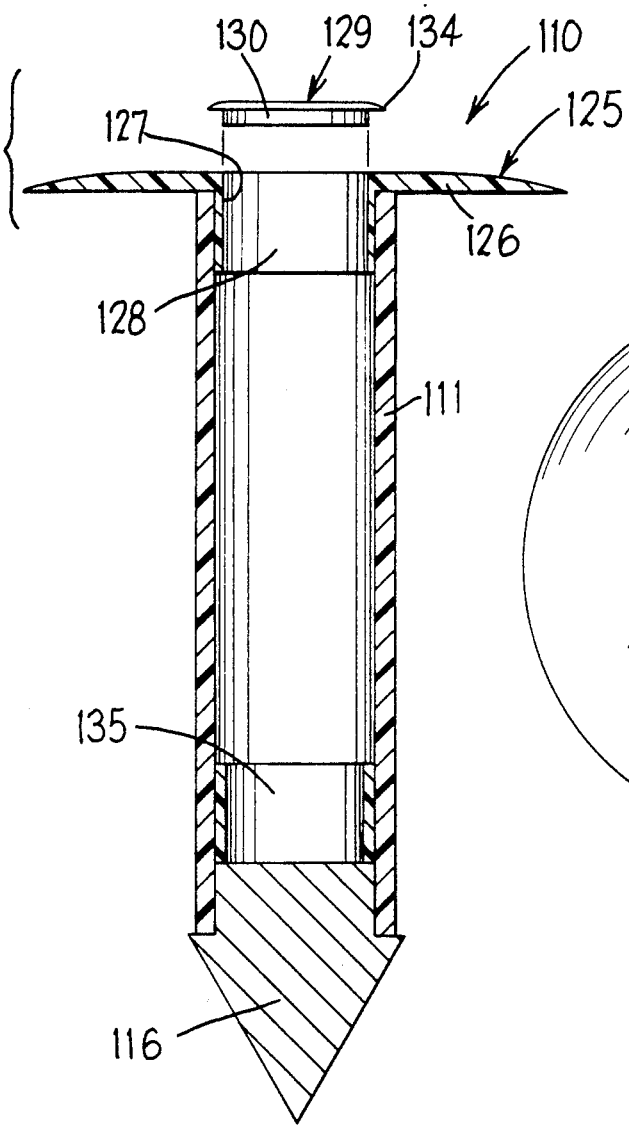
FIG. 4 is a central sectional side view similar to FIG. 1 but showing an alternative embodiment of the ground anchor of FIG. 1.
Figure 5:
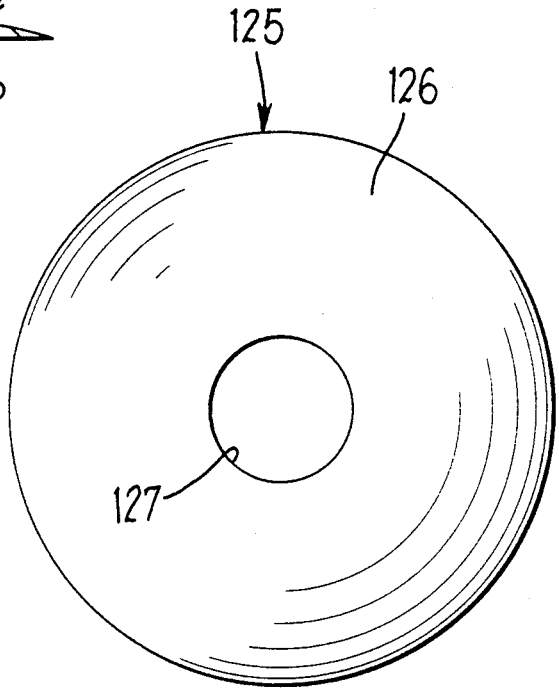
FIG. 5 is a top view of a collar which is a component of the ground anchor of FIG. 4.

FIG. 4 shows a ground anchor 110 which is an alternative embodiment of the ground anchor of FIG. 1. The ground anchor 110 includes a cylindrical vertical tube 111 having at the lower end thereof an end member 116, which are respectively identical to the tube and end member in FIG. 1 and are therefore not discussed in detail here. The ground anchor 110 includes at the upper end of the tube 111 a collar 125, FIG. 5 providing a top view of the collar. The collar 125 includes a flange portion 126 which extends horizontally, radially outwardly from the upper end of the tube 111, and has at the center thereof a central opening 127. The flange portion 126 tapers progressively in thickness near its radially outer end. The collar 125 also has an annular flange portion 128 which extends axially into the upper end of the tube 111 and which has an outside diameter substantially equal to the inside diameter of tube 111 so as to be securely frictionally retained within the tube. It is possible to adhesively secure the flange 128 to the tube 111 with any conventional and suitable adhesive, but in the preferred embodiment the frictional fit is sufficient to reliably secure them together. The axial flange 128 is coaxial to the opening 127, and has an inside diameter equal to the diameter of the opening 127.

An optional plastic storage cap 129 has a cylindrical portion 130 which has an outside diameter approximately equal to the diameter of the opening 127 and which can be snugly inserted into the opening 127. The cap 129 has at the upper end of the cylindrical portion 130 an outwardly projecting annular flange 134 which can engage the upper surface of the collar 125 to limit movement of the cylindrical portion 130 of the cap into the opening 127.

A cylindrical sleeve 135 of PVC material is disposed within the tube 111 immediately above the end member 116, and has an outside diameter substantially equal to the inside diameter of the tube 111 so that there is a very snug frictional fit therebetween which holds the sleeve 135 against axial movement within the tube 111. It is possible to adhesively secure the sleeve 135 in position within the tube 111, but in the preferred embodiment this is not necessary because of the snug frictional fit.

Through use of the driving member 31 of FIG. 2, the ground anchor 110 of FIG. 4 is installed in the ground in substantially the same manner as described above for the ground anchor of FIG. 1. In this case, the lower portion 36 of the driving member has a diameter which is less than the inside diameters of the flange 128 and sleeve 135.

After the ground anchor 110 has been installed in the ground, the radial flange 126 of the collar 125 has its underside disposed against the upper surface of the ground, and prevents grass from growing so thickly around the upper end of the tube 111 it would be difficult to visually locate the tube 111 when no post in inserted therein. An elongate post can be inserted into and removed from the tube. Since the diameter of the lower end of the post must be less than the inside diameter of the opening 127, the sleeve 135 is provided to prevent significant radial play of the lower end of the post and to thus ensure that the post is reliably held in a substantially uprighi position with negligible wobble.

When a post will be removed for more than a short period of time, the optional cap 129 can be inserted into the central opening 127 of the collar 125 in order to prevent dirt, rain, grass clippings and the like from entering the tube 111.

Although two preferred embodiments of the invention have been disclosed in detail for illustrative purposes, it will be recognized that there are variations or modification of the preferred embodiments which lie within the scope of the appended claims.

The embodiments of the invention in which an exclusive property or privilege is claimed are defined as follows:

1. A ground anchor for a post, comprising: an elongate vertically extending tube, and an end member fixedly supported on a lower end of said tube and having a downwardly projecting pointed portion, said end member having thereon an upwardly facing drive surface, including means defining a radially outwardly projecting first flange at an upper end of said tube, wherein said drive surface on said end member is provided within said tube, and wherein said means includes a collar member having an annular axially projecting second flange which is disposed snugly within an upper end of and which has a outside diameter substantially equal to the inside diameter of said tube, and having concentrically disposed at an upper end of said second flange a disk portion of diameter substantially larger than the diameter of said tube, said disk portion having therethrough an opening aligned with the opening through said annular flange, and said disk portion being said first flange.

2. A ground anchor according to claim 1, wherein said tube is substantially cylindrical; and wherein said end member has a substantially cylindrical portion which is snugly disposed in and has an outside diameter substantially equal to the inside diameter of said tube, and has below said cylindrical portion a substantially conical portion which is said pointed portion.

3. A ground anchor according to claim 2, wherein said conical portion of said end member has at an upper end thereof a base with a diameter approximately equal to an outside diameter of said tube, said cylindrical portion being concentrically disposed on and projecting upwardly from said base of said conical portion, and said drive surface being provided on said cylindrical portion within said tube.

4. A ground anchor according to claim 1, including a drain hole extending through said tube immediately above an uppermost portion of said end member.

5. A ground anchor according to claim 1, wherein said tube is made of a synthetic material and said end member is made of metal.

6. A ground anchor according to claim 1, including a cap having a cylindrical portion insertable into said opening in said disk portion and having at an upper end of said cylindrical portion thereof an outwardly projecting annular flange.

7. A ground anchor according to claim 1, including a sleeve disposed within said tube at a location spaced from said upper end thereof, said sleeve having an outside diameter substantially equal to an inside diameter of said tube so as to be snugly held against movement longitudinally of said tube, and having an inside diameter substantially equal to an inside diameter of said annular flange of said collar member.

8. A ground anchor according to claim 1, wherein a radially outer end portion of said first flange tapers progressively in thickness in a radially outward direction.

9. A ground anchor according to claim 1, including an elongate, vertically extending driving member having a lower end portion capable of vertical sliding movement relative to said tube and having on said lower end portion a downwardly facing driving surface engageable with said drive surface on said end member.

10. An apparatus according to claim 9, wherein said driving member has at an upper end thereof an upwardly facing drive surface.

11. An apparatus according to claim 9, wherein said drive surface on said end member is disposed within said tube and said lower end portion of said driving member is insertable into said tube, wherein said driving member includes an upper end portion which has a diameter larger than an inside diameter of said tube and which has a downwardly facing annular step surface at a lower end thereof, wherein when said driving surface at said lower end of said driving member is disposed against said drive surface on said end member said annular step surface is spaced above an upper end of said tube.

12. A ground anchor for a post, comprising: an elongate vertically extending tube, and an end member fixedly supported on a lower end of said tube and having a downwardly projecting pointed portion, said end member having thereon within said tube an upwardly facing drive surface, and including a collar member having an annular first portion snugly frictionally engaging an annular surface on said tube adjacent an upper end of said tube, and an annular second portion extending radially outwardly from said first portion and having a diameter substantially larger than the diameter of said tube and including removable cap means for sealingly obstructing the opening through said tube at an upper end of said tube.

13. A ground anchor according to claim 12, wherein said tube is substantially cylindrical; and wherein said end member has a substantially cylindrical portion which is snugly disposed in and which has an outside diameter substantially equal to the inside diameter of said tube, and has below said cylindrical portion of a substantially conical portion which is said pointed portion.

14. A ground anchor according to claim 13, wherein said conical portion of said end member has at an upper end thereof a base with a diameter approximately equal to an outside diameter of said tube, said cylindrical portion being concentrically disposed on and projecting upwardly from said base of said conical portion, and said drive surface being provided on said cylindrical portion within said tube.

15. A ground anchor according to claim 14, including a drain hole extending through said tube immediately above an uppermost portion of said end member.

16. A ground anchor according to claim 12, wherein a radially outer end portion of said annular second portion tapers progressively in thickness in a radially outward direction.

* * * * *